US007806406B1

(12) United States Patent
Simikic

(10) Patent No.: US 7,806,406 B1
(45) Date of Patent: Oct. 5, 2010

(54) BOARD GAME

(76) Inventor: Risto Simikic, 14 Deller Avenue, Cabramatta (AU) NSW 2166

( * ) Notice: Subject to any disclaimer, the term of this patent is extended or adjusted under 35 U.S.C. 154(b) by 0 days.

(21) Appl. No.: 12/270,383

(22) Filed: Nov. 13, 2008

(51) Int. Cl.
*A63F 3/00* (2006.01)

(52) U.S. Cl. ..... 273/243; 273/262

(58) Field of Classification Search ..... 273/243, 273/255, 260, 262
See application file for complete search history.

(56) References Cited

U.S. PATENT DOCUMENTS 3,342,493 A 9/1967 Lang
4,302,015 A 11/1981 Bowser et al.
5,029,871 A 7/1991 Willson, Jr. et al.
5,301,952 A 4/1994 Fitzgerald
5,360,216 A 11/1994 Counterman
5,413,350 A 5/1995 Taylor et al.
5,560,612 A 10/1996 Ippoliti et al.
D390,280 S 2/1998 Dunn
5,918,883 A 7/1999 McKenzie et al.
6,474,643 B1 * 11/2002 Rehus ..... 273/255
6,491,300 B2 12/2002 Harris et al.

* cited by examiner

*Primary Examiner*—Vishu Mendiratta

(57) ABSTRACT

The present invention features a board game comprising a game board, action cards, and playing pieces. The present invention also features methods of playing a board game wherein the object of the game is to move all of a player's pieces from a start position to a home position.

1 Claim, 2 Drawing Sheets

BOARD GAME

FIELD OF THE INVENTION

The present invention is directed to a board game for two players.

BACKGROUND OF THE INVENTION

The present invention features a board game for two players, wherein the object of the game is to attempt to move all of a player's pieces from a start position to a home position. The board game comprises a game board, a plurality of action cards, and a plurality of playing pieces. The present invention also features methods of playing a board game with two players, wherein the object of the game is to attempt to move all of a player's pieces from a start position to a home position.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
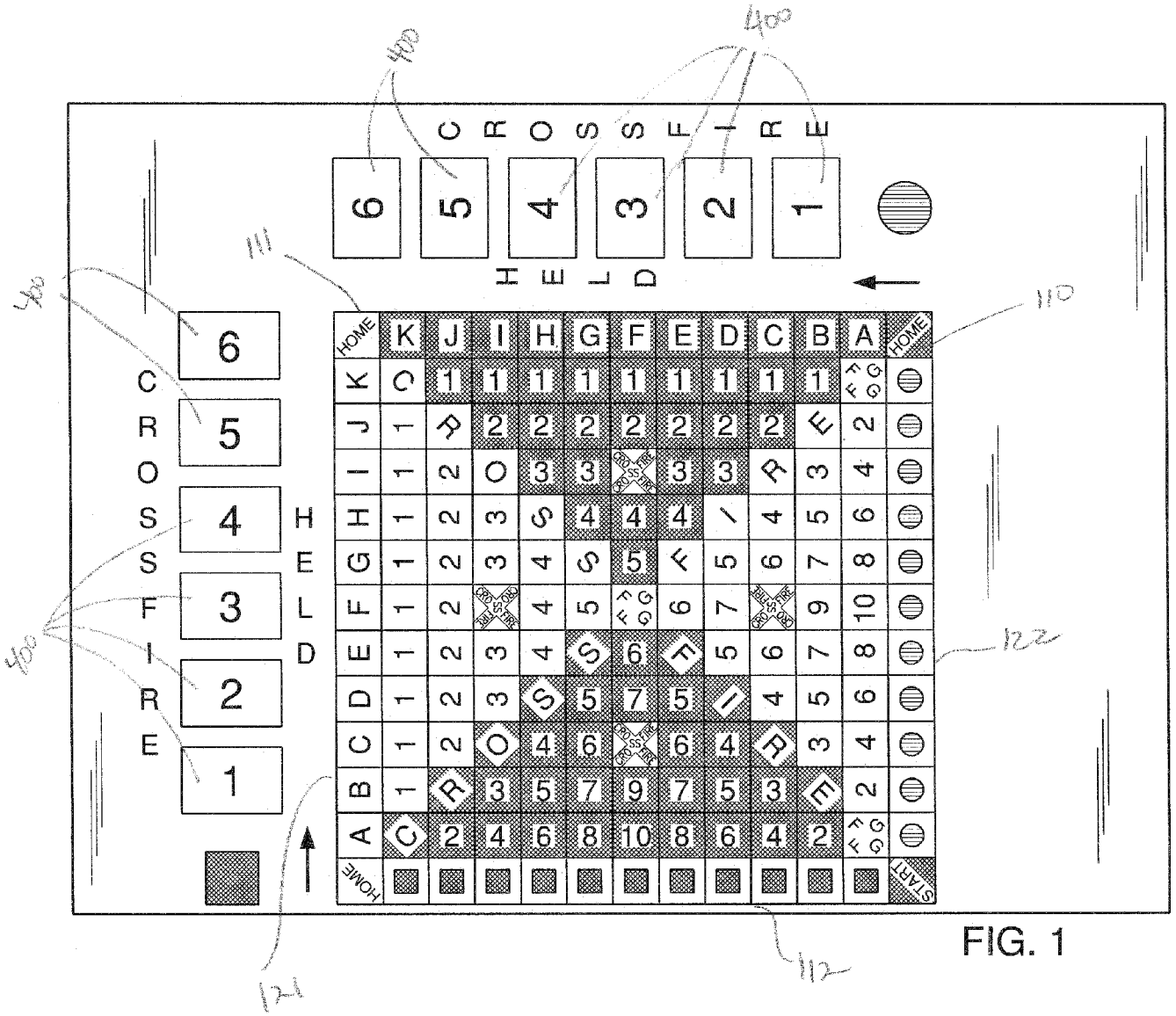
FIG. 1 is a front view of the game board of the board game of the present invention.
Figure 3:
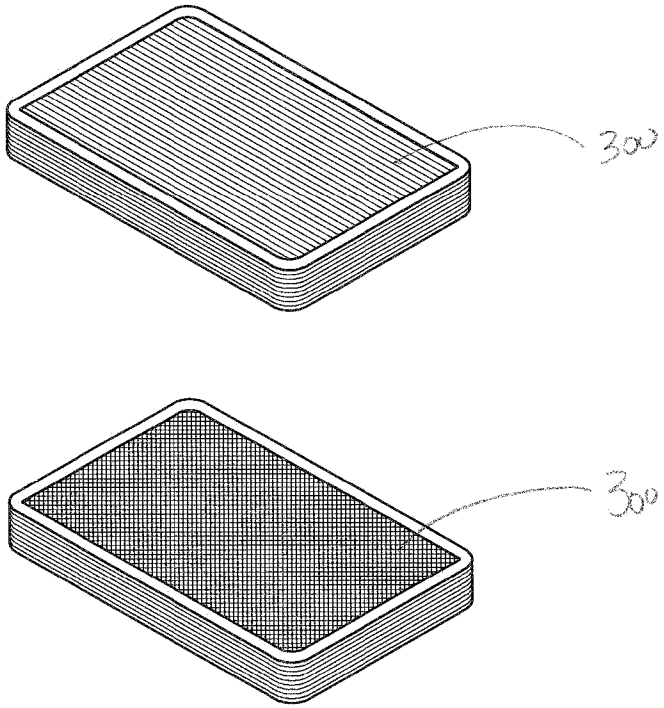
FIG. 3 is a perspective view of the action cards of the game board of the present invention.
Figure 2:
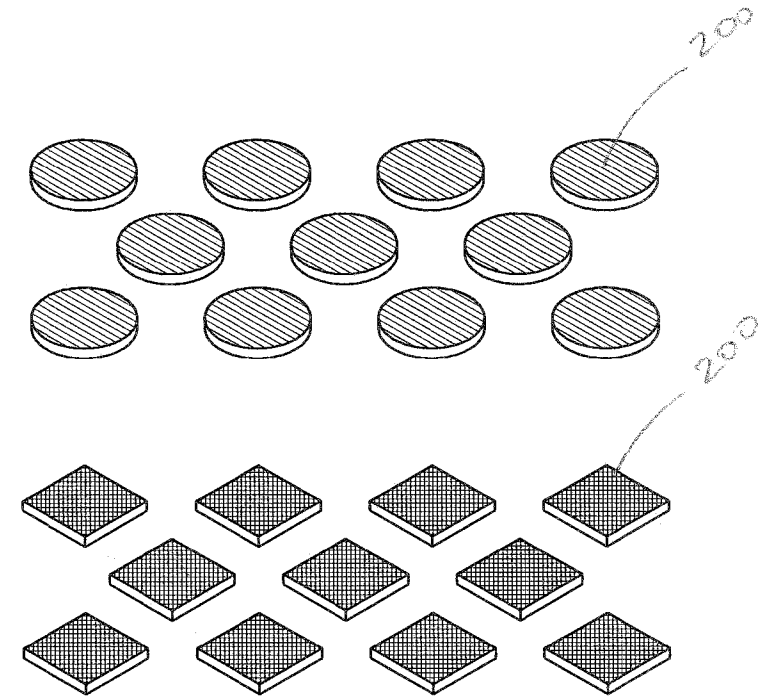
FIG. 2 is a perspective view of the playing pieces of the game board of the present invention.

The following is a listing of numbers corresponding to a particular element refer to herein:

100 board game
110 game board
111 top edge of game board
112 bottom edge of game board
121 left edge of game board
122 right edge of game board
200 playing piece
300 action card
400 action cards held by a player Referring now to FIG. 1, the present invention features a board game for two players, wherein the object of the game is to attempt to move all of a player's pieces from a start position to a home position. The board game comprises a game board, a plurality of action cards, and a plurality of playing pieces.

Game Board

The board game of the present invention comprises a game board. In some embodiments, the game board is constructed from a material comprising a cardboard, a plastic, the like, or a combination thereof. In some embodiments, the game board is constructed in the shape of a square, a rectangle, or the like.

As used herein, the term "about" refers to plus or minus 10% of the referenced number. For example, an embodiment wherein the game board is about 40 centimeters long includes a game board that is between 36 and 44 centimeters long.

In some embodiments, the game board is about 51 centimeters wide as measured from the left edge to the right edge and 38 centimeters long as measured from the top edge to the bottom edge.

In some embodiments, the game board is between about 30 to 40 centimeters long as measured from the top edge to the bottom edge. In some embodiments, the game board is between about 40 to 50 centimeters long as measured from the top edge to the bottom edge. In some embodiments, the game board is between about 50 to 60 centimeters long as measured from the top edge to the bottom edge.

In some embodiments, the game board is between about 30 to 40 centimeters wide as measured from the left edge to the right edge. In some embodiments, the game board is between about 40 to 50 centimeters wide as measured from the left edge to the right edge. In some embodiments, the game board is between about 50 to 60 centimeters wide as measured from the left edge to the right edge.

As showing in FIG. 1, in some embodiments, the game board has a grid of 169 squares arranged in 13 columns and 13 rows. In some embodiments, each column is designated with a letter. For example, the left-most column is designated Column A. In some embodiments, the column to the right of Column A is Column B, the column to the right of Column B is Column C, the column to the right of Column C is Column D, the column to the right of Column D is Column E, the column to the right of Column E is Column F, the column to the right of Column F is Column G, the column to the right of Column G is Column H, the column to the right of Column H is Column I, the column to the right of Column I is Column J, the column to the right of Column J is Column K, the column to the right of Column K is Column L, and the column to the right of Column L is Column M.

In some embodiments, each row is designated with a number. For example, the top-most row is designated Row 1. In some embodiments, the row below Row 1 is Row 2, the row below Row 2 is Row 3, the row below Row 3 is Row 4, the row below Row 4 is Row 5, the row below Row 5 is Row 6, the row below Row 6 is Row 7, the row below Row 7 is Row 8, the row below Row 8 is Row 9, the row below Row 9 is Row 10, the row below Row 10 is Row 11, the row below Row 11 is Row 12, and the row below Row 12 is Row 13.

As shown in FIG. 1 and Table 1, in some embodiments, the squares in Row 1 (A1, B1, C1, D1, E1, F1, G1, H1, I1, J1, K1, L1, M1) have the values "Home," "K," "J," "I," "H," "G," "F," "E," "D," "C," "B," "A," and "Home," respectively.

As shown in FIG. 1 and Table 1, in some embodiments, the squares in Column 1 (A1, A1, A3, A4, A5, A6, A7, A8, A9, A10, A11, A12, A13) have the values "Home," "K," "J," "I," "H," "G," "F," "E," "D," "C," "B," "A," and "Home," respectively.

In some embodiments the squares of the game board have the values listed in Table 1. The column letters and row numbered in bold face in Table 1 are not part of the game board but are for clarification purposes only.

TABLE 1

| Column Row | A | B | C | D | E | F | G | H | I | J | K | L | M |
|---|---|---|---|---|---|---|---|---|---|---|---|---|---|
| 1 | HOME | K | J | I | H | G | F | E | D | C | B | A | HOME |
| 2 | K | C | 1 | 1 | 1 | 1 | 1 | 1 | 1 | 1 | 1 | FG | |
| 3 | J | 1 | R | 2 | 2 | 2 | 2 | 2 | 2 | 2 | E | 2 | |
| 4 | I | 1 | 2 | O | 3 | 3 | CROSS FIRE | 3 | 3 | R | 3 | 4 | |
| 5 | H | 1 | 2 | 3 | S | 4 | 4 | 4 | I | 4 | 5 | 5 | |
| 6 | G | 1 | 2 | 3 | 4 | S | 5 | F | 5 | 6 | 7 | 8 | |
| 7 | F | 1 | 2 | CROSS FIRE | 4 | 5 | FG | 6 | 7 | CROSS FIRE | 9 | 10 | |
| 8 | E | 1 | 2 | 3 | 4 | S | 6 | F | 5 | 6 | 7 | 8 | |
| 9 | D | 1 | 2 | 3 | S | 5 | 7 | 5 | I | 4 | 5 | 6 | |
| 10 | C | 1 | 2 | O | 4 | 6 | CROSS FIRE | 6 | 4 | R | 3 | 4 | |
| 11 | B | 1 | R | 3 | 5 | 7 | 9 | 7 | 5 | 3 | E | 2 | |
| 12 | A | C | 2 | 4 | 6 | 8 | 10 | 8 | 6 | 4 | 2 | FG | |
| 13 | HOME | | | | | | | | | | | | |

In some embodiments, the Squares A1-A13, B2-B11, C3-C10, D4-D6, D8-D9, E5-E8, F6-F7, H6-H7, I5-I8, J4-J6, J8-J9, K3-K10, and L3-L11 are colored red. In some embodiments, the Squares G4 and G10, which are labeled with "Crossfire," are red.

In some embodiments, the Squares B1, B12, C1-C2, C11-C12, D1-D3, D10-12, E1-4, E9-E12, F1-F5 F8-F12, G1-G3, G4-G5, G8-G9, G11-G12, H1-5, H8-H12, I1-14, 19-I12, J1-J3, J10-J12, K1-K2, K11-K12, L1 and M1 are colored black. In some embodiments, the Squares D7 and J7, which are labeled with "Crossfire," are black.

In some embodiments, the Squares G7, L2, and L12, which are labeled with "FG," are colored a neutral color (e.g., tan, beige, the like).

Playing Pieces

The present invention comprises a plurality of playing pieces (e.g., twenty two playing pieces). In some embodiments, the pieces are in the shape of a first shape, a second shape, or a combination thereof. In some embodiments, a first shape includes a disc or the like, and a second shape includes a square or the like. In some embodiments, the present invention comprises 22 playing pieces, wherein 11 playing pieces are in the shape of a disc and 11 playing pieces are in the shape of a square.

In some embodiments, the playing pieces are constructed from a material comprising a plastic, a cardboard, a metal, the like, or a combination thereof.

Action Cards

The board game of the present invention comprises a plurality of action cards, each action card having a front face and a back face, wherein the front face displays an action statement. In some embodiments, the action statement is written in a first color or a second color. In some embodiments, a first color is black and a second color is red.

In some embodiments, an action statement includes "Forward," "Back," "Crossfire," "Free Turn," "Jump 5," "Jump 10," and so forth (see description of action statements below).

In some embodiments, the board game of the present invention comprises 165 action cards. In some embodiments, the action cards include one red "Crossfire" card, one black "Crossfire" card. In some embodiments, the action cards include 10 red "Home" cards and 10 black "Home" cards. In some embodiments, the action cards include 6 red "Forward" cards and 6 black "Forward" cards.

In some embodiments, the action cards include 2 red "Jump 5" cards and 2 black "Jump 5" cards. In some embodiments, the action cards include 1 red "Back 5" card and 1 black "Back 5" card. In some embodiments, the action cards include 1 red "Jump 10" card and 1 black "Jump 10" card. In some embodiments, the action cards include 1 red "5 Free Turns" card and 1 black "5 Free Turns" card. In some embodiments, the action cards include 1 red "Remove 1 Card Held" card and 1 black "Remove 1 Card Held" card. In some embodiments, the action cards include 1 red "Take 1 Back to Start" card and 1 black "Take 1 Back to Start" card.

In some embodiments, the action cards include 3 "Free Go" cards. In some embodiments, if a player draws a "Free Go" card and moves a playing piece to a "Free Go" space on the game board it is considered 1 turn.

In some embodiments, the action cards includes 48 red cards labeled with the action statements B1, B2, C1, C2, C3, C4, D1, D2, D3, D4, D5, D6, E1, E2, E3, E4, E5, E6, E7, E8, F1, F2, F4, F5, F6, F7, F9, F10, G1, G2, G3, G4, G5, G6, G7, G8, H1, H2, H3, H4, H5, H6, I1, I2, I3, I4, J1, and J2.

In some embodiments, the action cards includes 48 black cards labeled with the action statements B1, B2, C1, C2, C3, C4, D1, D2, D3, D4, D5, D6, E1, E2, E3, E4, E5, E6, E7, E8, F1, F2, F4, F5, F6, F7, F9, F10, G1, G2, G3, G4, G5, G6, G7, G8, H1, H2, H3, H4, H5, H6, I1, I2, I3, I4, J1, and J2.

Method of Playing Board Game

The present invention further comprises a method of playing a board game with two players, wherein the objective is the game is to attempt to move all of a player's playing pieces from a start position to a home position. The first player to move all of his/her pieces from the start position to the home position is the winner.

The method of playing a board game of the present invention comprises the steps of setting up the board game and placing the action cards face down in a pile. The players decide who will play first, and each player chooses to use either the black playing pieces or the red playing pieces. To set up the board game, the player using the red playing pieces places the 11 red playing pieces on the red squares M2-M12 such that one red game piece rests on Square M2, one red game piece rests on square M3, one red game piece rests on Square M4, one red game piece rests on Square M5, one red game piece rests on Square M6, and so forth. Likewise, the player using the black playing pieces places the 11 black playing pieces on the black squares B13-L13 such that one black game piece rests on Square B13, one black game piece rests on Square C13, one black game piece rests on Square D13, one black game piece rests on Square E13, one black game piece rests on Square F13, and so forth.

The Squares B13, C13, D13, E13, F13, G13, H13, I13, J13, K13, and L13, which are occupied by the red playing pieces at the start of the game, are known as the red start positions. The Squares M2, M3, M4, M5, M6, M7, M8, M9, M10, and M11, which are occupied by the black playing pieces at the start of the game, are known as the black start positions. The Squares B1, C1, D1, E1, F1, G1, H1, I1, J1, K1, and L1 are known as the black home positions. The Squares A2, A3, A4, A5, A6, A7, A8, A9, A10, A11, and A12 are known as the red home positions.

The object of the game is to attempt to move all of a player's playing pieces from its respective start position to its respective home position on the opposite side of the board. For example, the red player attempts to move the red playing piece on Square M2 to Square A2, the red playing piece on Square M3 to Square A3, the red playing piece on Square M4 to Square A4, and so forth. The black player attempts to move the black playing piece on Square B13 to Square B1, the black playing piece on Square C13 to Square C1, the black playing piece on Square D13 to Square D1, and so forth. Playing pieces may not be moved diagonally.

To begin the game, the first player draws an action card from the pile. The player may choose to play the card or hold the card. The maximum number of cards a player may hold is six. If the player holds the card, his/her turn is finished and the second player draws a card. If the player plays the card, he/she obeys the action statement written on the action card and places the card in a discard pile. For example, in some embodiments, the action statement is "Forward" in red, and the player moves one of his/her playing pieces that currently occupies a red square one space in the direction towards its respective home position. In some embodiments, the action statement is "Forward" in black, and the player moves one of his/her playing pieces that currently occupies a black square one space in the direction towards its respective home position.

In some embodiments, the action statement is "Home" in black. If the black player draws a black "Home" card, he/she may move one of his/her playing pieces to its respective home position, unless the playing piece occupies its start position. If the red player draws a black "Home" card, he/she may hold the card to prevent the other player from obtaining the card or place the card in the discard pile. Likewise, if the red player draws a red "Home" card, he/she may move one of his/her playing pieces to its respective home position, unless the playing piece occupies its start position. If the black player draws a red "Home" card, he/she may hold the card to prevent the other player from obtaining the card or place the card in the discard pile. A player cannot move one of his playing pieces into its respective home position unless he draws or plays a "Home" card in his/her color.

In some embodiments, the action statement corresponds to a specific square of the board, for example "D2" in red. If the player that draws the red "D2" card is the red player, he/she moves the playing piece that occupies one of the squares in Row 9 from its current position to the square that has a value of "2" (in red) and corresponds to the red start position labeled "D," which is Square D9 (see FIG. 1). If the player that draws the red "D2" card is the black player, he/she moves the playing piece that occupies one of the squares in Column C from its current position to the Square D9, the square that has a value of "2" (in red) and corresponds to the red start position labeled "D".

In some embodiments, the action statement is "Jump 5" in red, and the player moves one of his/her playing pieces that currently occupies a red square five spaces in the direction towards its respective home position. In some embodiments, the action statement is "Jump 5" in black, and the player moves one of his/her playing pieces that currently occupies a black square five spaces in the direction towards its respective home position. A player may not move his/her playing piece into a home position with one of these action cards. If a player cannot move 5 spaces, he/she may not use the action card.

In some embodiments, the action statement is "Jump 10" in red, and the player moves one of his/her playing pieces that currently occupies a red square ten spaces in the direction towards its respective home position. In some embodiments, the action statement is "Jump 10" in black, and the player moves one of his/her playing pieces that currently occupies a black square ten spaces in the direction towards its respective home position. A player may not move his/her playing piece into a home position with one of these action cards. If a player cannot move ten spaces, he/she may not use the action card.

In some embodiments, the action statement is "Back 5" in red, and the player moves one of his/her playing pieces that currently occupies a red square five spaces away from the direction of its respective home position. In some embodiments, the action statement is "Back 5" in black, and the player moves one of his/her playing pieces that currently occupies a black square five spaces away from the direction of its respective home position. A player may move his/her playing piece into a start position with one of these action cards. If a player cannot move 5 spaces, he/she may not use the action card.

In some embodiments, the action statement is "Crossfire" in red or black. If the red player draws the red "Crossfire" card, he/she may move the playing piece in Row 4 to Square F4 or move the playing piece in Row 10 to Square F10 (F4 and F10 are labeled "Crossfire" in red). If the red player draws the black "Crossfire" card, he/she may hold the card to prevent the opposing player from obtaining the card or discard the card in the discard pile. If the black player draws the black "Crossfire" card, he/she may move the playing piece in Column D to Square D7 or the playing piece in Column J to Square J7. If the black player draws a red "Crossfire" card, he/she may hold the card to prevent the opposing player from obtaining the card or discard the card in the discard pile. In some embodiments, either player can move to the next red/black "Crossfire" square on the game board if a card is chosen/drawn or held.

In some embodiments, the action statement is "5 Free Turns." If either player draws a "5 Free Turns" card, he/she may draw 5 cards and play or hold some or all of the cards. A player may not hold more than six cards at a time. A "5 Free Turns" card can be held for later use.

In some embodiments, the action statement is "Free Go." If the red player draws a "Free Go" card, he/she may move the playing piece in Row 2 to Square L2, the playing piece in Row 7 to Square G7, or the playing piece in Row 12 to Square L12. He/she may then take another turn and draw a card from the action card pile. Or, he/she may move to the next "Free Go" without taking another card from action card pile. If the black player draws a "Free Go" card, he/she may move the playing piece in Column L to either Square L2 or the Square L12 or move the playing piece in Column G to Square G7. He/she may then take another turn and draw a card from the action card pile. Or, he/she may move to the next "Free Go" without taking another card from action card pile.

In some embodiments, the action statement is "Remove 1 Card Held" in red or black. If the red player draws a red "Remove 1 Card Held" card, he/she may choose a red card that the black player is holding and either place it in the discard pile or hold the card for him/herself. If the black player draws a red "Remove 1 Card Held" card, he/she may hold the card to prevent the opposing player from obtaining the card or discard the card in the discard pile. If the black player draws a black "Remove 1 Card Held" card, he/she may choose a black card that the red player is holding and either discard it in the discard pile or hold the card for him/herself. If the red player draws a black "Remove 1 Card Held" card, he/she may hold the card to prevent the opposing player from obtaining the card or discard the card in the discard pile.

In some embodiments, the action statement is "Take 1 Back to Start" in red or black. If the red player draws a red "Take 1 Back to Start" card, he/she chooses a black playing piece that is resting on a red square and moves that piece back to its respective start position. If the black player draws a red "Take 1 Back to Start" card, he/she may hold the card to prevent the opposing player from obtaining the card or discard the card in the discard pile. If the black player draws a black "Take 1 Back to Start" card, he/she chooses a red playing piece that is resting on a black square and moves that piece back to its respective start position. If the red player draws a black "Take 1 Back to Start" card, he/she may hold the card to prevent the opposing player from obtaining the card or discard the card in the discard pile.

If a player's playing piece lands on a square already occupied by the opposing player's playing piece, the opposing player's playing piece is moved back to its original start position.

If a player draws a card for a playing piece that has been moved to its respective home position, the card discarded into the discard pile without being played.

If the action cards have been used, the card in the discard pile are shuffled and used again. The game ends when one player has moved all of his/her playing pieces to the home positions on the opposite side of the board.

In some embodiments, the game is played for 30 minutes (e.g., a half-hour version). In some embodiments, the half-hour version is played for 30 minutes and the player with the most number of playing pieces in their respective home positions is the winner. If both players have the same number of playing piece in their home positions, the player that had the least number of playing pieces sent back to their start positions wins. In some embodiments, the game is played for an extended period of time (e.g., marathon version). In some embodiments, if players play the marathon version, a playing piece in its respective home position may be sent back to its start position.

The following the disclosures of the following U.S. Patents are incorporated in their entirety by reference herein: U.S. Pat. No. 6,491,300 B2; U.S. Pat. No. 5,301,952; U.S. Pat. No. 5,918,883; U.S. Pat. No. 5,413,350; U.S. Pat. No. 4,302,015; U.S. Pat. No. 3,342,493; U.S. Pat. No. 5,360,216; U.S. Pat. No. 5,360,216; U.S. Pat. No. 5,029,871.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A board game for a first player and a second player, said board game comprising:

(a) a game board having a grid of 169 squares arranged in 13 columns and 13 rows; wherein a left-most column is Column A, a column next to Column A is Column B, a column next to Column B is Column C, a column next to Column C is Column D a column next to Column D is Column E, a column next to Column E is Column F, a column next to Column F is Column G a column next to Column G is Column H, a column next to Column H is Column I, a column next to Column I is Column J, a column next to Column J is Column K, a column next to Column K is Column L, and a column next to Column L is Column M; wherein a top-most row is Row 1, a row below Row 1 is Row 2, a row below Row 2 is Row 3, a row below Row 3 is Row 4, a row below Row 4 is Row 5, a row below Row 5 is Row 6, a row below Row 6 is Row 7, a row below Row 7 is Row 8, a row below Row 8 is Row 9, a row below Row 9 is Row 10, a row below Row 10 is Row 11, a row below Row 11 is Row 12, and a row below Row 12 is Row 13; wherein Row 1 has the values Home, K, J, I, H, G, F, E, D, C, B, A, and Home; wherein Column 1 has the values Home, K, J, I, H, G, F, E, D, C, B, A, and Home; wherein each square is assigned a letter and number based on it's respective Column and Row; wherein squares G4, D7, J7, and G10 are labeled with "Crossfire";

(b) a plurality of action cards, each action card having a front face and a back face, wherein the front face displays an action statement; wherein the action statement is written in a first color or a second color; wherein the action statement is selected from the group consisting of Forward, Back 5, Crossfire, Free Turn, Jump 5, Jump 10, Home, 5 Free Turns, Remove 1 Card Held, Take 1 Back to Start, Free Go, B1, B2, C1, C2, C3, C4, D1, D2, D3, D4, D5, D6, E1, E2, E3, E4, E5, E6, E7, E8, F1, F2, F4, F5, F6, F7, F9, F10, G1, G2, G3, G4, G5, G6, G7, G8, H1, H2, H3, H4, H5, H6, I1, I2, I3, I4, J1, and J2;

(c) twenty two playing pieces, wherein eleven playing pieces are constructed in a first shape and are for the first player and eleven playing pieces are constructed in a second shape and are for the second player; and (d) six holding spots disposed near the left edge of the game board for holding up to six action cards, and six holding spots disposed near the top edge of the game board for holding up to six action cards;

wherein squares A1, A2, A3, A4, A5, A6, A7, A8, A9, A10, A11, A12, A13, B2, B3, B4, B5, B6, B7, B8, B9, B10, B11, C3, C4, C5, C6, C7, C8, C9, C10, D4, D5, D6, D8, D9, E5, E6, E7, E8, F6, F7, H6, H7, I5, I6, I7, I8, J4, J5, J6, J7, J8, J9, K3, K4, K5, K6, K7, K8, K9, K10, L3, L4, L5, L6, L7, L8, L9, L10, L11, G4, and G10" are colored red;

wherein squares B1, B12, C1, C2, C11, C12, D1, D2, D3, D10, D11, D12, E1, E2, E3, E4, E9, E10, E11, E12, F1, F2, F3, F4, F5, F8, F9, F10, F11, F12, G1, G2, G3, G4, G5, G8, G9, G11, G12, H1, H2, H3, H4, H5, H8, H9, H10, H11, H12, I1, I2, I3, I4, I9, I10, I11, I12, J1, J2, J3, J10, J11, J12, K1, K2, K11, K12, L1, M1, D7, and J7 are colored black;

wherein an object of the board game is to attempt to move all playing pieces from a start position to a home position.

* * * * *